US006740220B1

(12) United States Patent
Medeiros et al.

(10) Patent No.: US 6,740,220 B1
(45) Date of Patent: May 25, 2004

(54) ELECTROCATALYTIC CATHODE DEVICE OF PALLADIUM AND IRIDIUM ON A HIGH DENSITY OR POROUS CARBON SUPPORT AND A METHOD FOR MAKING SUCH A CATHODE

(75) Inventors: Maria G. Medeiros, Bristol, RI (US); Eric G. Dow, Barrington, RI (US); Russell R. Bessette, Mattapoisett, MA (US); James M. Cichon, Stamford, CT (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/632,011

(22) Filed: Jul. 28, 2000

(51) Int. Cl.[7] ..... C25D 3/56; C25D 5/18

(52) U.S. Cl. ..... 205/102; 205/103; 205/159; 205/257

(58) Field of Search ..... 205/102, 103, 205/104, 159, 257

(56) References Cited

U.S. PATENT DOCUMENTS 5,578,175 A * 11/1996 Lin et al. ..... 204/290.12
6,010,606 A * 1/2000 Denton et al. ..... 204/284
6,110,354 A * 8/2000 Saban et al. ..... 205/775
6,309,969 B1 * 10/2001 Oskam et al. ..... 438/687

OTHER PUBLICATIONS

James A. Cox and Robert K Jaworski, Voltammetric Reduction and Determination of Hydrogen Peroxide at an Electrode Modified with a Film Containing Palladium and Iridium, Anal. Chem., vol. 61, No. 19, Oct. 1, 1989, pp 2176–2178.*

Frederick A. Lowenheim, Electroplating, McGraw–Hill Book Company, New York, 1978, pp 12–13.*

* cited by examiner

*Primary Examiner*—Roy King
*Assistant Examiner*—William T. Leader
(74) *Attorney, Agent, or Firm*—James M. Kasischke; Michael F. Oglo; Jean Paul A. Nasser

(57) ABSTRACT

The present invention relates to a method of producing an electrocatalytic cathode for use in an electrochemical cell system comprising the steps of providing a carbon substrate and simultaneously depositing palladium and iridium on the carbon substrate by cyclic voltammetry or by controlled potential coulometry. The simultaneous deposition of the palladium and iridium is preferably carried out using a solution containing 1.0 mM palladium chloride, 2.0 mM sodium hexachloroiridate, 0.2M potassium chloride, and 0.1M hydrochloric acid.

12 Claims, 5 Drawing Sheets

ELECTROCATALYTIC CATHODE DEVICE OF PALLADIUM AND IRIDIUM ON A HIGH DENSITY OR POROUS CARBON SUPPORT AND A METHOD FOR MAKING SUCH A CATHODE

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION (1) Field of the Invention

The present invention relates to a method of producing an improved carbon substrate cathode coated with palladium and iridium which is highly efficient toward catholyte reduction and is very stable.

(2) Description of the Prior Art

Aluminum anodes used in aqueous batteries with, for example, silver (II) oxide or air cathodes have been extensively investigated. The use of a hydrogen peroxide catholyte in combination with an aluminum anode has been the subject of several studies. When aluminum is combined with hydrogen peroxide in a caustic electrolyte, the overall cell reaction is:

$$2Al+3HO_2^- \rightarrow 2AlO_2^- + OH^- + H_2O \quad (1)$$

Operating cell voltages in the 1.2–1.7V range, depending on current density, have been routinely obtained. The Al—$H_2O_2$ electrochemical couple compares favorably with the Al—AgO couple and other high energy density primary battery systems. An energy density of 360 Wh $dm^{-3}$ is projected to be achievable for the Al—$H_2O_2$ solution phase catholyte system whereas an energy density of 290 Wh $dm^{-3}$ is projected for a similarly configured Al—AgO system.

An ion diffusion membrane is not used in the semi-fuel cells studied to reduce complexity, weight, and cost while increasing reliability and cell voltage. The approach, however, results in the catholyte being in direct contact with both the anode and the electrocatalytic cathode substrate. A direct, non-electrochemical reaction will thus occur. Unless the rate of this direct reaction is low compared to the electrochemical anodic and cathodic reactions, the direct reaction will significantly reduce the overall efficiency of the cell. Additional reductions in efficiency can occur due to the corrosion reaction of aluminum with hydroxide ions and the decomposition reaction of $H_2O_2$.

$$\text{Corrosion Reaction: } 2Al+2H_2O+2OH^- \rightarrow 2AlO_2^- + 3H_{2(g)} \quad (2)$$

$$\text{Decomposition Reaction: } 2H_2O_2 \rightarrow 2H_2O + O_{2(g)} \quad (3)$$

Improved catalysis for the reduction of $H_2O_2$ should result in reductions of the direct and the decomposition reactions, thus improving significantly the electrochemical efficiency of the cell.

A magnesium anode and either hydrogen peroxide or sodium hypochlorite catholyte have also been investigated. The overall cell reaction in each case is as follows:

$$Mg+HO_2^- + H_2O \rightarrow Mg^{2+} + 3OH^- \quad (4)$$

$$Mg+OCl^1 + H_2O \rightarrow Mg^{2+} + Cl^- + 3OH^- \quad (5)$$

Cell voltages in the 1.1 to 1.5V range have been obtained. Like the aluminum-hydrogen peroxide system, these systems also are operated without a membrane and thus have to be concerned with the direct reaction of the catholyte ($HO_2^-$ or $OCl^-$) with the magnesium anode. The hypochlorite system also exhibits decomposition and precipitation reactions.

$$\text{Decomposition Reaction: } 2OCl^- \rightarrow Cl^- + ClO_2 \quad (6)$$

$$\text{Precipitation Reactions: } Mg^{2+} + 2OH^- \rightarrow Mg(OH)_{2(g)} \quad (7)$$

$$Mg^{2+} + CO_3^{2-} \rightarrow MgCO_{3(g)} \quad (8)$$

Here again, improved catalysis will result in reduction of the decomposition and precipitation reactions.

Several catalysts have been investigated for use in fuel cells. Many of these catalysts (including palladium and iridium independently) have been incorporated in carbon based pastes. J. P. Collman and K. Kim, *J. American Chemical Society,* 108:24 (1986) 7847, have reported that iridium porphyrin complexes are very active catalysts. Cox and Jaworski, *J. Analytical Chemistry,* 61 (1989) 2176, have used a palladium-iridium combination on a glassy carbon microelectrode for the quantitative determination of $H_2O_2$. A combination of palladium and iridium has been shown to improve the electrochemical efficiency for the reduction of $H_2O_2$ and to improve cell voltage relative to the use of a metallic silver cathode.

Under high rate discharge (800–1000 mA/$cm^2$) efficient electrochemical reduction of hydrogen peroxide (approximately 70% coulombic efficiency) with a concomitant decrease in its heterogeneous decomposition has been achieved through the use of a Pd/Ir catalyzed cathode substrate. Efficiencies 30 to 40% lower are obtained at current densities below 100 mA/$cm^2$. It should be noted that applications of the Pd/Ir catalysis of a nickel cathode substrate have been limited to high rate, single use, short duration (less than 30 minutes) situations. When attempts have been made to reuse the catalyzed nickel substrate, performance changed with the second use and typically decreased significantly with a third use.

The patent literature contains a number of patents related to the manufacture of cathodes for use in chemical cells. These include U.S. Pat. No. 4,506,028 to Fukuda et al., U.S. Pat. No. 4,514,478 to Binder et al., U.S. Pat. No. 5,296,429 to Marsh et al., U.S. Pat. No. 5,395,705 to Dorr et al., and U.S. Pat. No. 5,578,175 to Lin et al.

The Fukuda et al. patent relates to an electrode substrate for a fuel cell. The substrate is prepared by a process comprising mixing 30 to 50 wt % carbon fiber, 20 to 50 wt % of a binder, and 20 to 50 wt % of an organic granule, press-shaping the resultant mixture, curing the shaped product, and calcinating the cured product.

The Binder et al. patent relates to a porous carbon cathode for use in an electrochemical cell. The cathode is made by wetting the carbon black with a 1:1 to 1:3 mixture of isopropyl alcohol:water, adding a binding agent thereto, smearing the resulting stiff paste on a thin expanded metal screen and pressing and rolling to a desired thickness, drying the cathode sheet in a vacuum oven at about 100° C. for one hour while a weight is placed above and below the cathode sheet which is sandwiched between two pieces of blotting paper, the total weight applied being sufficient for the cathode to retain structural integrity, removing the weight and blotting papers and inserting the cathode sheet in an elevated drying oven at about 280° C. for about one hour, and cooling the cathode sheet between blotting paper, repressing and rolling.

The Marsh et al. patent relates to an electrocatalytic cathode which is comprised of nickel specially coated with one or a combination of platinum, ruthenium, rhodium, osmium, palladium, and iridium. The cathode is produced by pretreating a nickel electrode with a hydrochloric acid bath and then by applying the metal coating by plating methods.

The Lin et al. patent relates to a process for manufacturing an iridium and palladium oxides coated titanium electrode. The process comprises preparing a titanium substrate having a surface, applying iridium and palladium to be formed on the surface of the titanium substrate, and heat treating the iridium and palladium oxides applied titanium substrate to obtain an iridium and palladium oxides-coated titanium electrode.

The Door et al. patent relates to an electrochemical cell having at least one electrode containing carbon fiber paper coated with an uncoagulated mixture of binder and catalytically active metal particles at catalyst/binder ratios of about 2/1 to about 25/1. The metal catalyst particles include at least one of the metals of Group VIII of the Periodic Table of Elements, preferably rhodium, ruthenium, palladium, osmium, iridium, and platinum (platinum black).

SUMMARY OF THE INVENTION

Accordingly, it is an object of the present invention to provide a method for producing an improved electrocatalytic cathode for use in an electrochemical cell.

It is a further object of the present invention to provide a method for producing an improved electrocatalytic cathode as above that is highly efficient toward catholyte reduction and very stable.

It is still a further object of the present invention to provide a method for producing an improved electrocatalytic cathode as above which is capable of performing over a wide range of energy densities and is suited for low powering endurance as well as for high power applications.

The foregoing objects are attained by the method of the present invention.

In accordance with the present invention, a method of producing an electrocatalytic cathode for use in an electrochemical cell system comprises the steps of providing a carbon substrate and simultaneously depositing palladium and iridium on the carbon substrate by cyclic voltammetry or by controlled potential coulometry. The simultaneous deposition of the palladium and iridium is preferably carried out using a solution containing 1.0 mM palladium chloride, 2.0 mM sodium hexachloroiridate, 0.2M potassium chloride, and 0.1M hydrochloric acid.

Other details of the method of the present invention, as well as other objects and advantages attendant thereto, are set forth in the following detailed description and the accompany figures.

DESCRIPTION OF THE PREFERRED EMBODIMENT(S)

Figure 1B:
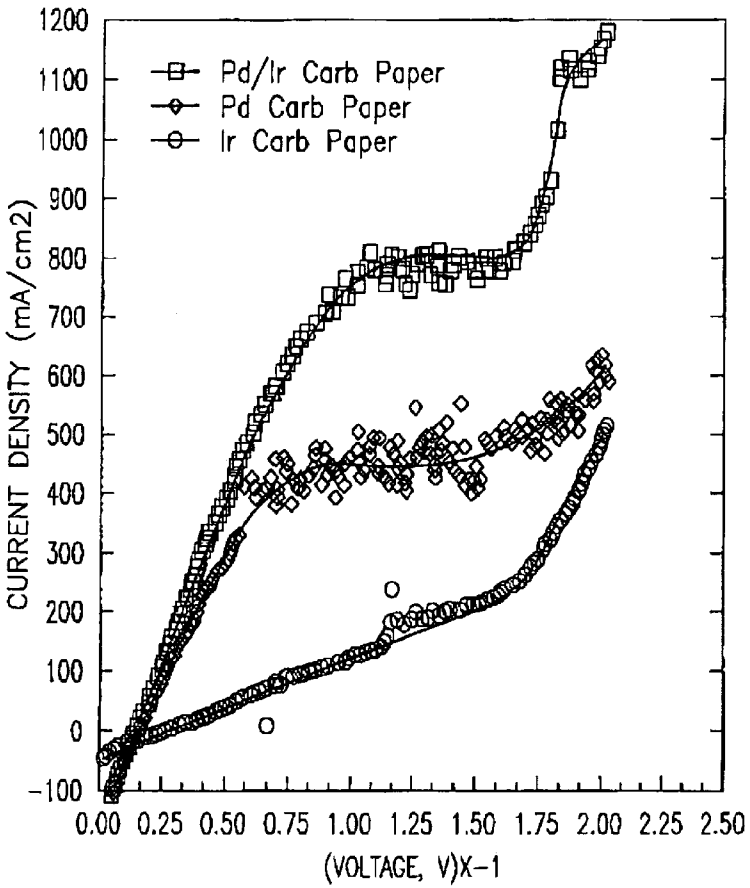
FIGS. 1*a* and 1*b* are polarization curves for various catalysts on high density carbon and on carbon paper toward reduction of hydrogen peroxide.

As previously discussed, the present invention relates to an improved cathode for use in a semi-fuel cell and a method of manufacturing or making same.

A cathode in accordance with the present invention is formed by the simultaneous deposition of palladium and iridium on a carbon substrate. The carbon substrate can be high density carbon or carbon paper, which is a porous carbon.

The simultaneous deposition of the palladium and iridium on the carbon substrate can be carried out by cyclic voltammetry or by controlled potential coulometry. When used, the cyclic voltammetry can be carried out at any one of a number of potential ranges between −1.0V to +1.06V, preferably between about −0.15V to +1.06V, vs. a silver/silver chloride (Ag/AgCl) reference electrode and at any of a number of scan rates, preferably from about 1.0 millivolt/sec to about 65 millivolts/sec. The degree of loading of the catalyst on the carbon substrate can be controlled by the scan rate or by the number of cycles, preferably from 5 to 45 cycles. Typically, the simultaneous deposition of the palladium and iridium is carried out by cyclic voltammetry at a potential from −0.150V to −0.300V vs. silver/silver chloride at a scan rate of 10 mV/s for 25 cycles. When using controlled potential coulometry, the deposition is carried out at −0.25V vs. silver/silver chloride for 10 minutes. Any of a number of potentials between 1.0V to −1.0V vs. silver/silver chloride can be used. The degree of loading, in this latter case, is controlled by the application of the controlled potential for a time in the range of from about 3.0 to 10 minutes.

The solutions used for either of the above deposition techniques are preferably heated to 70° C. and preferably contain 1.0 mM palladium (II) chloride, 2.0 mM sodium hexachloroiridate (IV) ($Na_2IrCl_6$), 0.2M KCl, and 0.1M Hcl. A three electrode cell consisting of the substrate, high density or carbon paper, working electrode, a silver/silver chloride reference electrode, and a platinum auxiliary electrode is preferably used for the above depositions.

To show the improvements to be gained by the platinum/iridium coated carbon cathode of the present invention, a three electrode cell consisting of the catalyzed substrate as the working electrode, a silver/silver chloride reference electrode and a spectroscopic grade carbon rod counter electrode was employed. Full cell performance was carried out using either a 25×38 mm cell made of polycarbonate and Teflon or a 38×200 mm cell made of Plexiglass. A Teflon insert used with the 25×38 mm cell permitted an electrode area of 1.0 cm$^2$ (0.5 cm×2.0 cm) to be used in the flow through cell as well as a 6.45 cm$^2$ (2.5 cm×2.5 cm) electrode. A Vexar spacer maintained the cell gap at 0.7 mm in both cells. The anode and cathode were mounted on individual current collector bus bars. The two electrodes were mounted vertically and were separated by the Vexar screen spacer. The catholyte and the electrolyte were pumped into the bottom of the cell, flowed between the anode and the cathode surfaces and exited at the top of the cell. A number of such cells were incorporated into a closed loop flowing electrolyte apparatus consisting, in series, of a heated electrolyte reservoir, a peristaltic pump, a heat exchanging coil in a constant temperature bath to maintain temperature, the flow through cell and a return to the reservoir. Cell current was regulated by means of a multistep load resistance substitution box and a dynaload. Cell current, voltage, inlet and outlet temperatures, and evolved gas flow rate were simultaneously monitored and recorded by a computer data logging system.

The aluminum anode was an ALUPOWER™ alloy designated EB50V. The electrolyte contained 3.0M NaOH, 0.5M $H_2O_2$ and 40 gram/Liter (g/L) of sea salt. Its temperature was maintained at 55° C. and the flow rate was 100 $cm^3$/min.

Evolved gas was collected with a gas tight syringe from a T connection and rubber septum at the exit to the cell. Gas samples were taken several times during a particular use.

The gas samples were analyzed for $H_{2(g)}$ and $O_{2(g)}$ with a chromatograph such as a Hewlett Packard Capillary Gas Chromatograph Model 5890 Series II Plus equipped with an HP PLOT Molecular Sieve 5A column (30 m×0.32 mm×0.25 mm film thickness) and a thermal conductivity detector.

Scanning electron microscopy was carried out using a JEOL USA Model 6300 instrument. The SEM working distance was 15 mm giving a resolution of 5.0 nm.

Figure 1A:
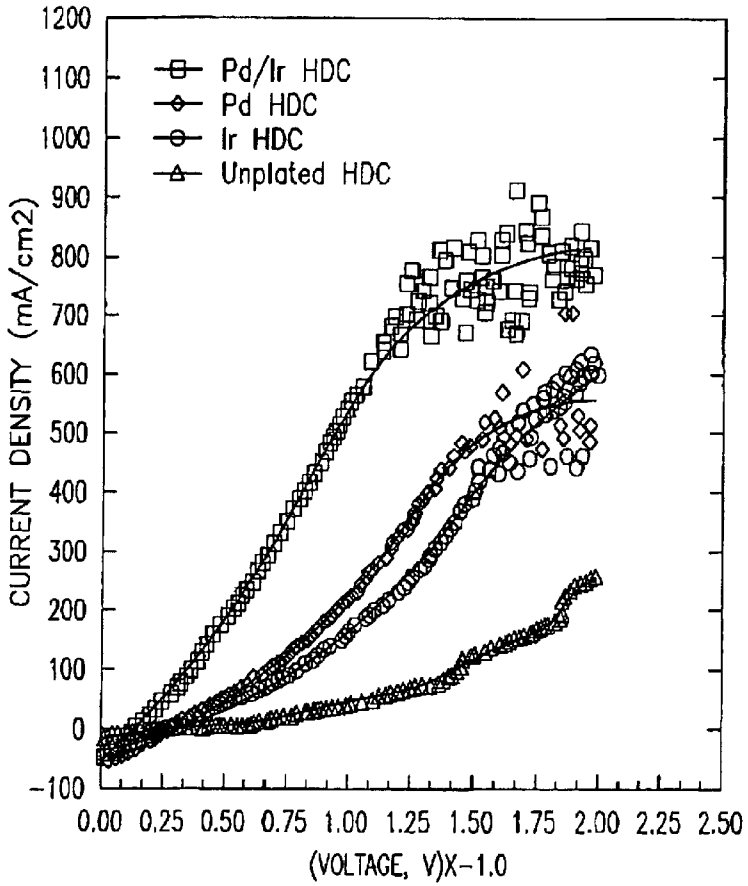

A high density planar carbon substrate was found to support the most uniform electrocatalytic surface. A comparison of the catalytic performance of iridium alone, palladium alone, and a palladium/iridium combination for the reduction of $H_2O_2$ in a sodium hydroxide-seal salt electrolyte at 55° C. on high density carbon and on carbon paper is presented in FIGS. 1*a* and 1*b*. The superior performance of the combination of Pd/Ir over the entire current density range is clearly evident from these figures.

Figure 2:
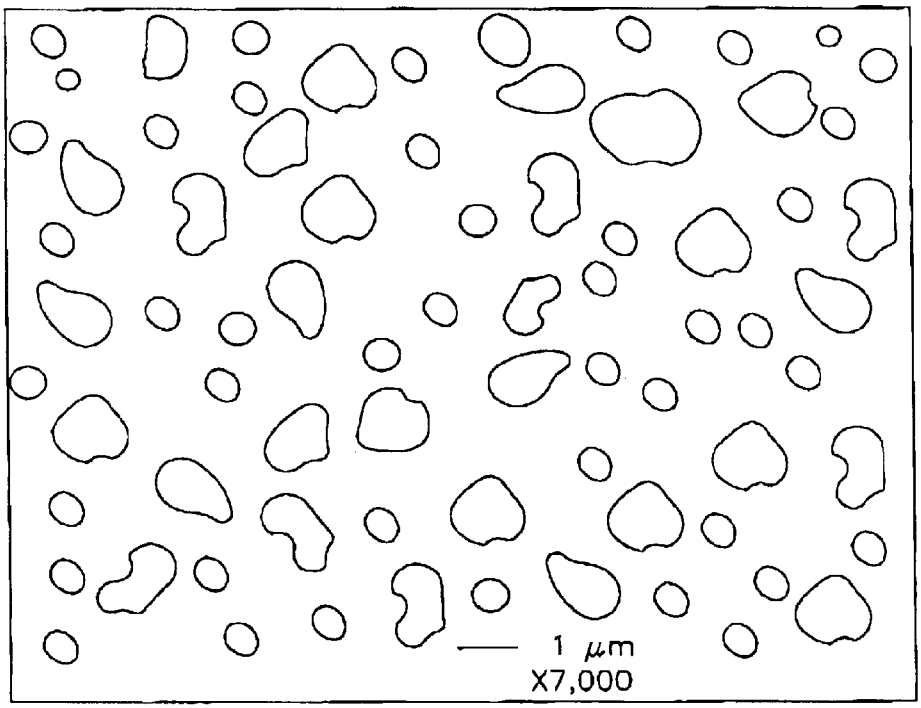
FIG. 2 is a photomicrograph of a palladium/iridium combination on a high density carbon at 7000× magnification.

A scanning electron micrograph of the palladium-iridium combination on the carbon substrate at 7000× magnification is shown in FIG. 2. The clusters observed are reasonably spherical and are uniformly distributed over the substrate surface. An Energy Dispersive Spectrometry spectrum has confirmed the presence of palladium and iridium on the surface. Oxygen is also observed but no chlorine is found. Careful analysis of EDS mapping shows the palladium, iridium, and oxygen to be at the same locations on the surface.

A series of tests were carried out using a 30×200 mm flowing test apparatus to quantify the efficiencies of the four reactions which take place during cell discharge. The corrosion, direct and decomposition reactions provide no useful electrical energy. Only the electrochemical reaction produces electrical energy. The following table illustrates the Al—$H_2O_2$ reactions.

TABLE I

Al—$H_2O_2$ Reactions

| | |
|---|---|
| 1. Electrochemical Reaction | $2Al + 3HO^-_2 \rightarrow 2AlO^-_2 + OH + H_2O$ |
| 2. Corrosion Reaction | $2Al + 2H_2O + 2OH^- \rightarrow 2AlO^-_2 + 3H_{2(g)}$ |
| 3. Direct Reaction | $2Al + 3H_2O_2 + 2OH^- \rightarrow 2AlO^-_2 + 4H_2O$ |
| 4. Decomposition Reaction | $2H_2O_2 \rightarrow 2H_2O + O_{2(g)}$ |

The aluminum electrochemical efficiency is determined by mass difference and integration of the current over time of the experiment. The $H_2O_2$ electrochemical efficiency is determined by the cerium (IV) titration of the $H_2O_2$, using 1,1-phenanthroline iron complex as the visual indicator, at the start and at the end of the experiment and integration of the current over time of the experiment. The A1 corrosion efficiency is based on the $H_{2(g)}$ analysis and the $H_2O_2$ decomposition efficiency is based on the $O_{2(g)}$ analysis. The percent direct reaction is obtained by difference. These efficiencies are summarized in Table II. The precision figures listed are based on triplicate determinations.

TABLE II

Reaction Efficiencies for the Al—$H_2O_2$ Semi-Fuel Cell

| Reaction | Percent Efficiency (Al based) | Percent Efficiency ($H_2O_2$ based) |
|---|---|---|
| Electrochemical | 54% ± 4.5 | 38% ± 2.5 |
| Corrosion | 25% ± 1.4 | — |
| Direct | 23% ± 1.9 | 38% ± 0.8 |
| Decomposition | — | 25% ± 2.2 |

Determination of the corrosion and decomposition reaction efficiencies has been hampered by the difficulty of obtaining dry samples of $H_{2(g)}$ and $O_{2(g)}$ from the electrolyte stream. Variation in electrochemical efficiency is due to the need to further optimize the electrolyte flow rate. These results indicate that an increase of 25 to 35 percent in the electrochemical efficiency should be achievable.

Figure 3:
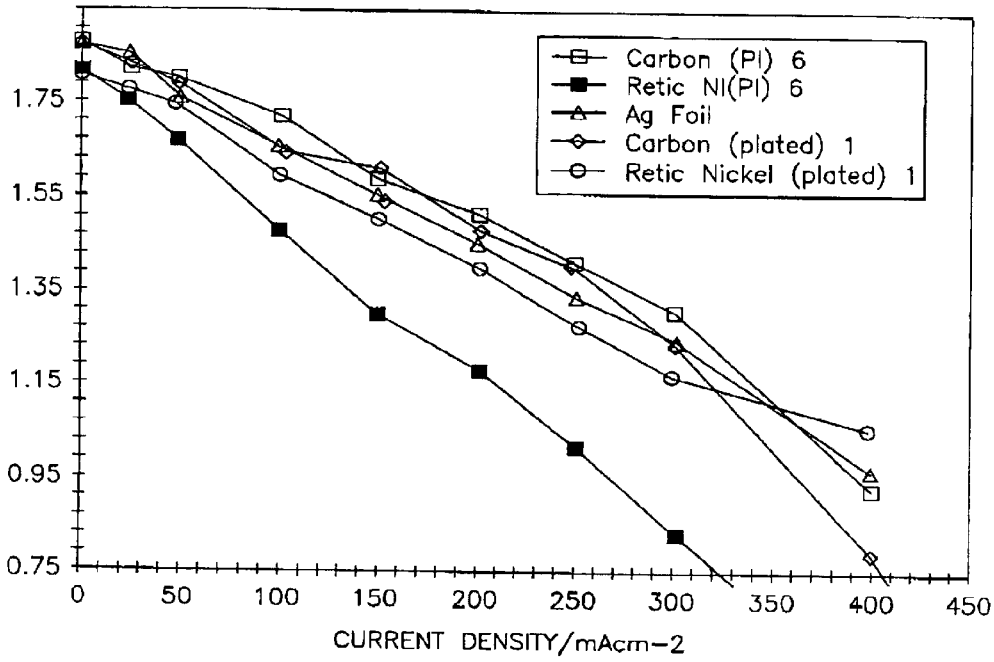
FIG. 3 is a graph showing semi-fuel cell voltages at various current densities for catalyzed substrates after discharges at 100 mA/cm$^2$ for 3.75 hours.

Multiple Al—$H_2O_2$ semi-fuel discharges at 100 ma/$cm^2$ for 45 minutes followed by the acquisition of cell voltages at various current densities show continued catalytic activity and stable electrochemical performance for the Pd/Ir catalyzed carbon substrate. Semi-fuel cell voltages at various current densities for Pd/Ir catalyzed high density planar carbon and reticulated nickel, obtained initially (carbon and nickel plate) and after discharge at 100 mA/$cm^2$ for long duration (3.75 hours; carbon and nickel plate) are shown in FIG. 3. The cell performance using a silver foil baseline catalyst is included for comparison.

The voltage of the cell containing the Pd/Ir catalyzed carbon, after 3.75 hours of $H_2O_2$ discharge, is higher than the silver foil baseline by 70 mV in the 100–300 mA/$cm^2$ range and is essentially identical to its initial performance. The voltage of the cell containing Pd/Ir catalyzed reticulated nickel is lower over the entire current range, both initially and after 3.75 hours of discharge, than the baseline silver foil. The poorer performance of the cell incorporating catalyzed reticulated nickel after discharge relative to its initial performance is clearly evident.

Cell voltages measured at 250 mA/$cm^2$ for the Al—$H_2O_2$ semi-fuel cell containing Pd/Ir catalyzed high density carbon after successive discharges at 100 mA/$cm^2$ for forty five minutes were as much as 380 mV higher than when a similarly catalyzed reticulated nickel cathode was employed. Improved long term performance was also demonstrated by the cell containing catalyzed carbon. The cell voltage decreased to 1.00 V after twelve forty five minute discharges at 100 mA/$cm^2$ whereas the 1.00 V level was obtained only after six forty-five minute 100 mA/$cm^2$ discharges with the cell containing catalyzed reticulated nickel.

Figure 4:
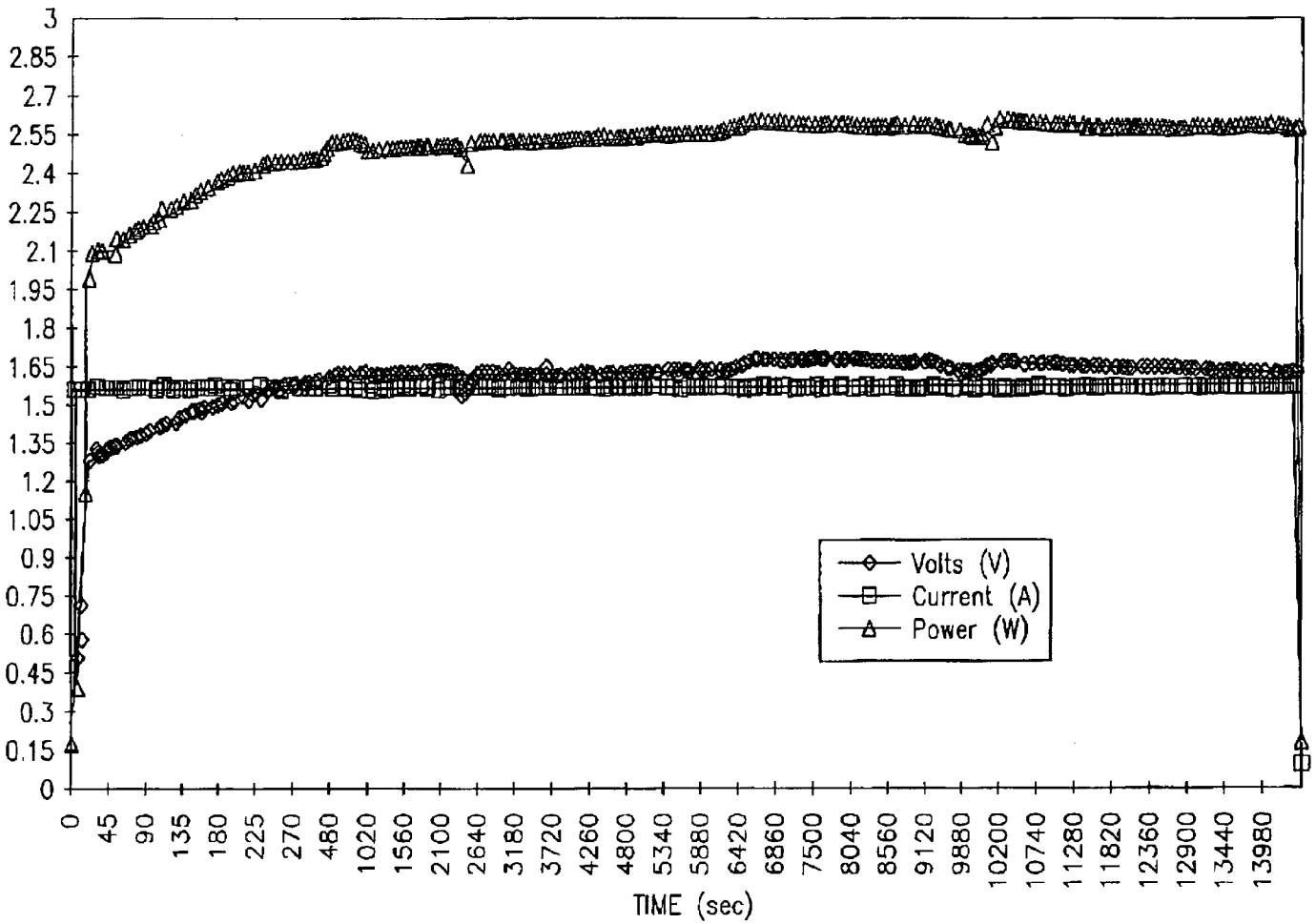
FIG. 4 is a graph showing the long term stability on carbon paper for four hours.

Long term stability of the Pd/Ir catalyst on carbon paper (porous carbon) has been demonstrated. FIG. 4 shows the exceptionally stable voltage that is achieved at 25 mA/$cm^2$ with the aluminum-hydrogen peroxide semi-fuel cell incorporating a Pd/Ir on carbon paper support cathode.

Figure 5:
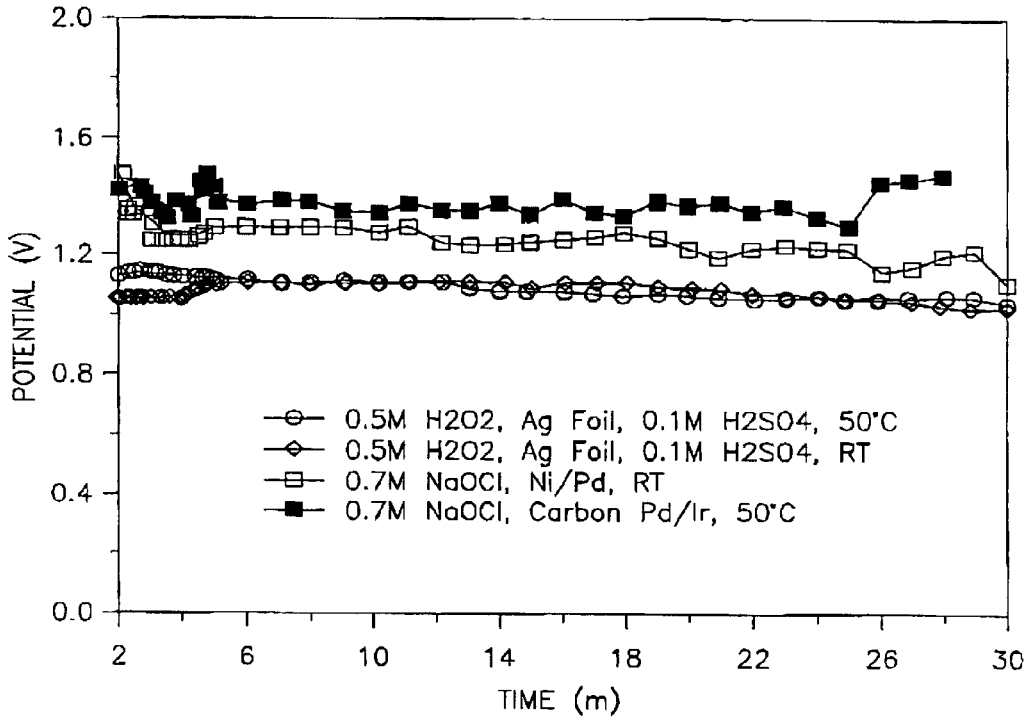
FIG. 5 is a graph showing the variation of voltage with time for both hydrogen peroxide and sodium hypochlorite at a constant current density of 25 mA/cm$^2$.

FIG. 5 depicts the performance of the palladium/iridium on carbon catalyst in a magnesium-sodium hypochlorite semi-fuel cell. This figure also shows the superior cell voltage obtained with the palladium/iridium on carbon catalyst relative to a palladium on reticulated nickel catalyst.

As can be seen from the foregoing, a palladium/iridium on carbon cathode formed in accordance with the present invention will yield higher cell voltages relative to a similar cell incorporating a silver catalyst cathode or a palladium/iridium on nickel substrate cathode and will demonstrate greater stability relative to a similarly catalyzed nickel substrate cathode. A palladium/iridium on carbon cathode formed in accordance with the present invention will demonstrate improved long term performances relative to a similarly catalyzed nickel substrate cathode or a silver catalyst cathode and will yield increased electrochemical efficiency relative to a similarly catalyzed nickel substrate cathode or a silver catalyst cathode. Still further, a palladium/iridium on carbon cathode in accordance with the present invention can be used in a semi-fuel cell incorporating an aluminum or magnesium anode, hydrogen peroxide or hypochlorite catholyte and an acidic or basic catholyte medium.

It is apparent that there has been provided in accordance with the present invention an electrocatalytic cathode device of palladium and iridium on a high density or porous carbon cathode support and a method for making such a cathode which fully satisfy the means, objects, and advantages set forth hereinbefore. While the present invention has been described in the context of specific embodiments thereof, other modifications, variations, and alternatives will become apparent to those skilled in the art having read the foregoing description. Therefore, it is intended to embrace such modifications, variations, and alternatives which fall within the broad scope of the appended claims.

What is claimed is:

1. A method for producing an electrocatalytic cathode for use in an electrochemical cell system comprising the steps of:

providing a carbon substrate; and simultaneously depositing palladium and iridium on said carbon substrate by cyclic voltammetry;

wherein said depositing step comprises depositing said palladium and iridium from a solution containing 1.0 mM $PdCl_2$, 2.0 mM $Na_2IrCl_6$, 0.2M KCl, and 0.1M HCl.

2. The method according to claim 1 wherein said carbon substrate providing step comprises providing a high density carbon substrate.

3. The method according to claim 1 wherein said carbon substrate providing step comprises providing a carbon paper substrate.

4. The method according to claim 1 wherein said depositing step further comprises performing said cyclic voltammetry at a voltage in the range of +1.06V to −1.0V vs. a silver/silver chloride reference electrode at a scan rate in the range of from about 1.0 millivolt/sec to about 65 millivolt/sec for about 5 to 45 cycles.

5. The method according to claim 1 wherein said depositing step further comprises performing said cyclic voltammetry at a voltage in the range of −0.150V to −0.300V vs. a silver/silver chloride reference electrode at a scan rate of 10 mv/s for 25 cycles.

6. The method according to claim 1 wherein the maximum positive excursion reached during said cyclic voltammetry is approximately −0.15V.

7. The method according to claim 1 wherein said solution is heated to about 70° C.

8.A method for producing an electrocatalytic cathode for use in an electrochemical cell system comprising the steps of:

providing a carbon substrate; and simultaneously depositing palladium and iridium on said carbon substrate by controlled potential coulometry;

wherein said depositing step comprises depositing said palladium and iridium from a solution containing 1.0 mM $PdCl_2$, 2.0 mM $Na_2IrCl_6$, 0.2M KCl, and 0.1M HCl.

9. The method according to claim 8 wherein said carbon substrate providing step comprises providing a high density carbon substrate.

10. The method according to claim 8 wherein said carbon substrate providing step comprises providing a carbon paper substrate.

11. The method according to claim 8 wherein said depositing step comprises carrying out said controlled potential coulometry at a voltage of −0.25V vs. a silver/silver chloride reference electrode for 10 minutes.

12. The method according to claim 8 wherein said depositing step comprises carrying out said controlled potential coulometry at a potential between 1.0V to −1.0V vs. a silver/silver chloride reference electrode for a time in the range of from about 3 to 10 minutes.

* * * * *